US007530753B2

(12) United States Patent
Kobayashi et al.

(10) Patent No.: US 7,530,753 B2
(45) Date of Patent: May 12, 2009

(54) WRITING IMPLEMENT

(75) Inventors: Yoshihiro Kobayashi, Isesaki (JP); Youichi Iwabuchi, Isesaki (JP)

(73) Assignee: Kabushiki Kaisha Pilot Corporation, Tokyo-To (JP)

( * ) Notice: Subject to any disclaimer, the term of this patent is extended or adjusted under 35 U.S.C. 154(b) by 244 days.

(21) Appl. No.: 10/526,743

(22) PCT Filed: May 14, 2004

(86) PCT No.: PCT/JP2004/006530

§ 371 (c)(1),
(2), (4) Date: Mar. 7, 2005

(87) PCT Pub. No.: WO2004/101292

PCT Pub. Date: Nov. 25, 2004

(65) Prior Publication Data

US 2006/0013642 A1 Jan. 19, 2006

(30) Foreign Application Priority Data

May 15, 2003 (JP) ..... 2003-137726

(51) Int. Cl.
*B43K 29/00* (2006.01)

(52) U.S. Cl. ..... 401/194; 401/48

(58) Field of Classification Search ..... 401/195, 401/48, 104, 52, 95
See application file for complete search history.

(56) References Cited

U.S. PATENT DOCUMENTS 6,799,918 B1 * 10/2004 Scolnik ..... 401/195
2005/0036336 A1 * 2/2005 Yang ..... 362/579

FOREIGN PATENT DOCUMENTS

| | | |
|---|---|---|
| CN | 2072022 U | 2/1991 |
| JP | 56-176881 | 12/1981 |
| JP | 57-4800 | 1/1982 |
| JP | 2-94189 | 7/1990 |
| JP | 6-46978 | 6/1994 |
| JP | 7-40185 | 7/1995 |

(Continued)

OTHER PUBLICATIONS

Chinese Office Action (with an English Translation thereof) dated Mar. 21, 2008 in connection with Chinese Patent Application No. 200480013006.7, which is a foreign counter part of the present application.

*Primary Examiner*—David J Walczak
(74) *Attorney, Agent, or Firm*—Wenderoth, Lind & Ponack, L.L.P.

(57) ABSTRACT

A writing implement including a plurality of component parts A, B, C, etc. is satisfactory in balance and stability during writing operations and can be smoothly handled for minute, reciprocating, turning motions during writing operations. The writing implement including the component parts A, B, C etc. has its center of gravity in a part thereof between a position at 20 mm from the tip of a projected writing element and a position corresponding to the middle of the overall length thereof, and the weight of the part thereof between the position at 20 mm from the tip of the projected writing element and the position corresponding to the middle of the overall length is not less than 50% of the total weight of the writing implement.

19 Claims, 7 Drawing Sheets

FOREIGN PATENT DOCUMENTS

| | | |
|---|---|---|
| JP | 8-29631 | 3/1996 |
| JP | 09-039470 | 2/1997 |
| JP | 9-39470 | 2/1997 |
| JP | 2552369 | 10/1997 |
| JP | 2001-150864 | 6/2001 |
| JP | 2001-270281 | 10/2001 |

* cited by examiner

WRITING IMPLEMENT

TECHNICAL FIELD

The present invention relates to a writing implement including a plurality of writing parts.

BACKGROUND ART

Techniques relating to the center of gravity of a writing implement have been proposed. For example, a writing implement is disclosed in JP 2001-270281 A (Patent document 1) having its center of gravity in a middle region of a barrel having front, middle and back regions and capable of being stably handled in minute, reciprocating, turning motions for writing.

The inventors of the present invention conducted studies to develop a writing implement that can be easily handled in minute, reciprocating, turning motions and found that a writing implement makes minute, reciprocating, turning motions to move its writing point up and down as shown in FIG. 3 when the writing point is shifted from the end of the last stroke of one letter to a position to start writing the next letter. A writing implement capable of being easily handled in minute, reciprocating, turning motions has an axis of turning passing corresponding to or substantially corresponding to its center of gravity. It is inferred that such a writing implement can be easily handled in reciprocating, turning motions because the writing implement has a small rotational inertia about the axis of turning.

The center of gravity of the writing implement disclosed in JP 2001-270281 A including the barrel having the front, the middle and the back region can be set in the middle region by taking into consideration the total weight of the writing implement and the respective weights of the component parts. However, the writing implement constructed simply so that the center of gravity is in the middle region of the barrel could not give a hand gripping the writing implement satisfactory sensation of balance and stability.

A writing implement designed to place the center of gravity in its middle region, ignoring weight distribution is not necessarily capable of being satisfactorily handled in minute, reciprocating, turning motions.

A region denoted by the term "middle region" in Patent document 1 extends from a range having a diameter decreasing in a curve from a front end toward a middle part to a range having a diameter decreasing in a curve from the back end toward the middle part. According to the definition of the term "middle region", the middle region could be a part near the tip of the writing implement or near the push button, depending on the shape of the writing implement. Thus, the position of the middle region defined by this term is very vague and hence the conception of weight distribution cannot be introduced into the writing implement mentioned in Patent document 1.

If weight distribution is ignored and an attention is paid only to the position of the center of gravity, the center of gravity can be set in the middle region even if front and back parts of the writing implement are formed from metallic parts. However, such a writing implement is ill-balanced and is unable to give a satisfactory sensation of stability to the hand gripping the writing implement. When the writing implement is gripped by a hand in a tilted position for writing, the metallic parts respectively having high specific weights destroy the balance and spoil the stability of the writing implement. When the front and the back part remote from the center of gravity are formed from metallic parts respectively having high specific weights, the writing implement has a large rotational inertia and cannot be smoothly operated in minute, reciprocating, turning motions.

As generally known, rotational inertia indicates the degree of difficulty in starting a body for rotation and the degree of difficulty in stopping a rotating body. Generally, it is easier to turn a straight bar about an axis passing through the center of the straight bar than turning the same straight bar about an axis passing through one of its ends because the diameter of a circle followed by an end of the straight bar when the straight bar is turned about the axis passing through the center of the straight bar is smaller than that of a circle followed by one of the ends of the straight bar when the straight bar is turned about the axis passing through the other end of the straight bar. Thus, the position of the center of gravity of a body is closely related with the rotational inertia of the body; the rotational inertia of the body is the least if the axis of rotation passes through the center of gravity of the body and the rotational inertia increases with the distance of the axis of rotation from the center of gravity.

Therefore, the rotational inertia can be reduced by making the axis of rotation pass through the center of gravity. However, it was found that the facility of handling the writing implement in minute, reciprocating, turning motions cannot be improved simply by setting the axis of turning of the writing implement at the center of gravity because the writing implement consists of many component parts and the rotational inertia of the writing implement is the sum of the respective rotational inertias of the component parts.

The least rotational inertia of a writing implement can be expressed by:

$$I=dI_1+dI_2+dI_3+\ldots+dI_n$$

where I is the minimum rotational inertia of the writing implement, and $dI_1$, $dI_2$, $dI_3$, . . . are the rotational inertias of the component parts A, B, C, etc. about an axis of rotation passing through the center of gravity of the writing implement.

DISCLOSURE OF THE INVENTION

Accordingly, it is an object of the present invention to solve problems in the foregoing prior art and to provide a writing implement that is well-balanced and capable of giving a satisfactory sensation of stability to the hand gripping the writing implement, of being handled in smooth, minute, reciprocating, turning motions for a satisfactory writing operation.

The inventors of the present invention studied the balance and stability of writing implements during writing operations and have found that a hand grips a writing implement by placing the tips of the thumb, the first finger and the second finger on a part a of the writing implement and resting a part b of the writing implement at the joint of the thumb and the first finger as shown in FIG. 14, and the writing implement gives satisfactory sensations of balance and stability during writing operations if the writing implement has its center of gravity at a point between the parts a and b and the most part of the weight of the writing implement is concentrated on a part of the writing implement between the parts a and b.

Generally, a writing implement with a projecting writing element, such as a mechanical pencil, a ballpoint pen, a fountain pen or a marker, has a length between 120 and 180 mm and the tip part of the writing implement is tapered to facilitate seeing the tip of the writing element. Therefore, the part a on which the tips of the thumb, the first finger and the second finger are placed is behind the tapered tip part. Although different writing implements have tip parts of different shapes, respectively, the length of the tip part including the writing element is between about 15 and about 20 mm and hence the part a is at a distance between 15 and 20 mm backward from the tip of the writing element. Although dependent on the size of the hand gripping the writing implement, the part b that rests on the joint of the thumb and the first finger is at least a short distance behind the middle part of the writing implement. Consequently, the writing implement is able to give satisfactory sensations of balance and stability when the writing implement has its center of gravity at a position between a part at 20 mm from the tip of the writing element and the middle part and has weight concentrated on a part near the center of gravity.

The present invention has been made on the basis of the foregoing knowledge acquired by the inventors of the present invention. A writing implement according to the present invention including component parts A, B, C, etc. is characterized in that its center of gravity is at a position between a position at 20 mm from the tip of a projected writing element and a position corresponding to the middle of the overall length thereof, and the weight of a part between the position at 20 mm from the tip of the projected writing element and the position corresponding to the middle of the overall length thereof is not less than 50% of the total weight thereof.

The writing implement is characterized in that the center of gravity is at a position between the middle of a part between the position at 20 mm from the tip of the writing element and the position corresponding to the middle of the overall length thereof and the middle of the overall length thereof.

The writing implement is characterized by a weight adjusting part placed in a part between the position at 20 mm from the tip of the writing element and the position corresponding to the middle of the overall length thereof.

The writing implement is characterized in that the weight adjusting part is formed of a metal.

The writing implement is characterized in that a tip part and/or a back part thereof is formed of a metal having a low specific gravity or a resin having a low specific gravity.

The writing implement is characterized in that the tip part and/or the back part is formed of a metal or a resin having a specific gravity lower than the specific gravity of a part between the position at 20 mm from the tip of the writing element and the position corresponding to the middle of the overall length thereof.

The writing implement is characterized in that the total weight of the component parts A, B, C, etc. is 15 gf or above.

The writing implement is characterized in having a rotational inertia between 4,300 and 25,000 gf·mm$^2$ about an axis passing the center of gravity.

The writing implement is characterized in having a rotational inertia of 20,000 gf·mm$^2$ or below about an axis passing the center of gravity.

Possible metals having a low specific gravity are those having a specific gravity lower than that of brass, such as aluminum (specific gravity: 2.7 gf/cm$^3$), aluminum alloys magnesium (specific gravity: 1.74 gf/cm$^3$), and magnesium alloys. Possible resins having a low specific gravity are those having a specific gravity below 1.0 gf/cm$^3$ and lower than those of polycarbonate resins, such as polypropylene resins (specific gravity: 0.90 to 0.91 gf/cm$^3$ and/or polyethylene resins (specific gravity: 0.91 to 0.97 gf/cm$^3$).

DETAILED DESCRIPTION OF PREFERRED EMBODIMENTS

Figure 1:
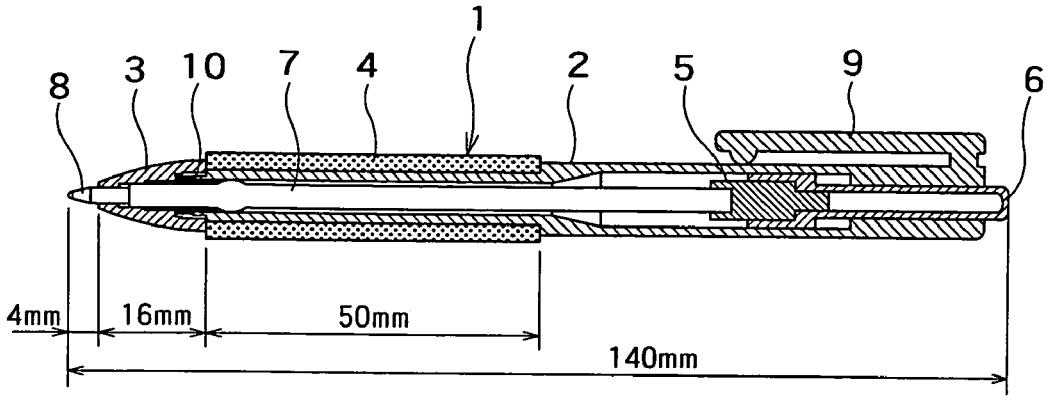
FIG. 1 is a longitudinal sectional view of a writing implement in a first embodiment according to the present invention.

Preferred embodiments of the present invention will be described with reference to the accompanying drawings, in which the same parts and positions are denoted by the same reference characters.

Referring to FIG. 1 showing a writing implement 1 in a first embodiment according to the present invention, a barrel 2 of a polypropylene resin, i.e., a resin having a low specific gravity, has a reduce gripping part having an outer diameter smaller than that of other parts. A grip member 4 of a silicone rubber having a high specific gravity of about 1.2 gf/cm$^3$ is put on the gripping part of the barrel 2. This writing implement 1 is a push-button ballpoint pen. A barrel cap 3 formed of a PC resin (polycarbonate resin) is screwed in the front end of the barrel 2. A ballpoint pen refill is inserted in the barrel 2 and is pushed backward by a coil spring formed by coiling a hard steel wire. The ballpoint pen refill has a cartridge tube 7 of a PP resin (polypropylene resin) containing an oil ink, and a ballpoint pen tip 8 having a socket rotatably holding a tungsten carbide ball and attached to the front end of the cartridge tube 7.

The barrel 2 is provided in its inner surface with a cam groove, not shown, for guiding a rotary cam 5 formed of a POM resin (polyoxymethylene resin) for axial movement and for turning. A projection formed on the rotary cam 5 is engaged in the cam groove. A push button 6 formed of a PC resin is inserted in a back part of the barrel 2 so as to project partly from the back end of the barrel 2. The push button 6 has a cam part for axially moving and turning the rotary cam 5 in its front part. A clip 9 is formed integrally with a back part of the barrel 2.

The writing implement is 13.6 gf in total weight and 140 mm in overall length with the ballpoint tip 8 projected from the front end of the barrel cap 3, i.e., with the ballpoint tip set at a writing position. The center of gravity of the push-button writing implement is at a position which is 67.8 mm from the writing point. The push-button writing implement has a rotational inertia I of about 20,000 gf·mm$^2$ about an axis passing through the center of gravity perpendicularly to the axis of the barrel 2.

Figure 2:
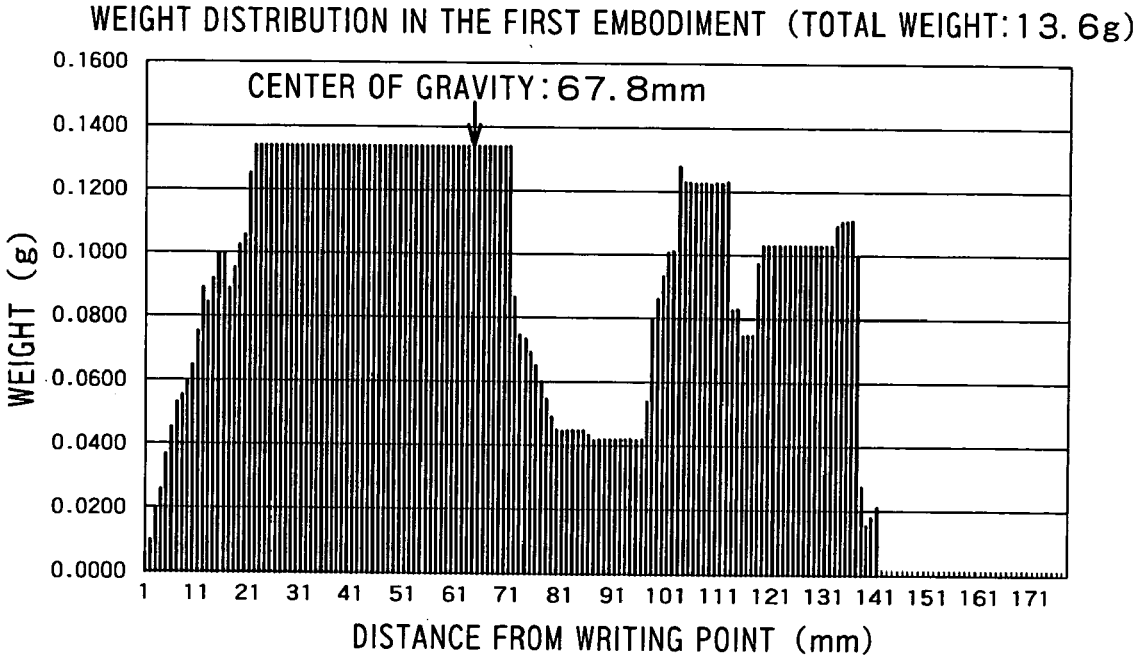
FIG. 2 is a diagram showing weight distribution in the writing implement shown in FIG. 1.

The weight of the writing implement is distributed in a weight distribution curve shown in FIG. 2 when the writing implement is set in a writing condition with its writing element projected. The grip member 4 is formed of the elastic material having a high specific gravity in a big thickness so that the weight of a part of the writing implement between a position at 20 mm from the writing point and a position at the middle of the overall length is not less the 50% of the total weight of the writing implement. More concretely, the weight of the part of the writing implement between the position at 20 mm from the writing point and the position at the middle of the overall length, i.e., a front half of 70 mm in length measured from the writing point of the writing implement is 7.0 gf, which is about 51% of the total weight of the writing implement. The writing implement is sliced in 1 mm thick slices, the weight of each slice is determined by adding up the respective weights of parts of the component parts included in the slice.

Figure 3:
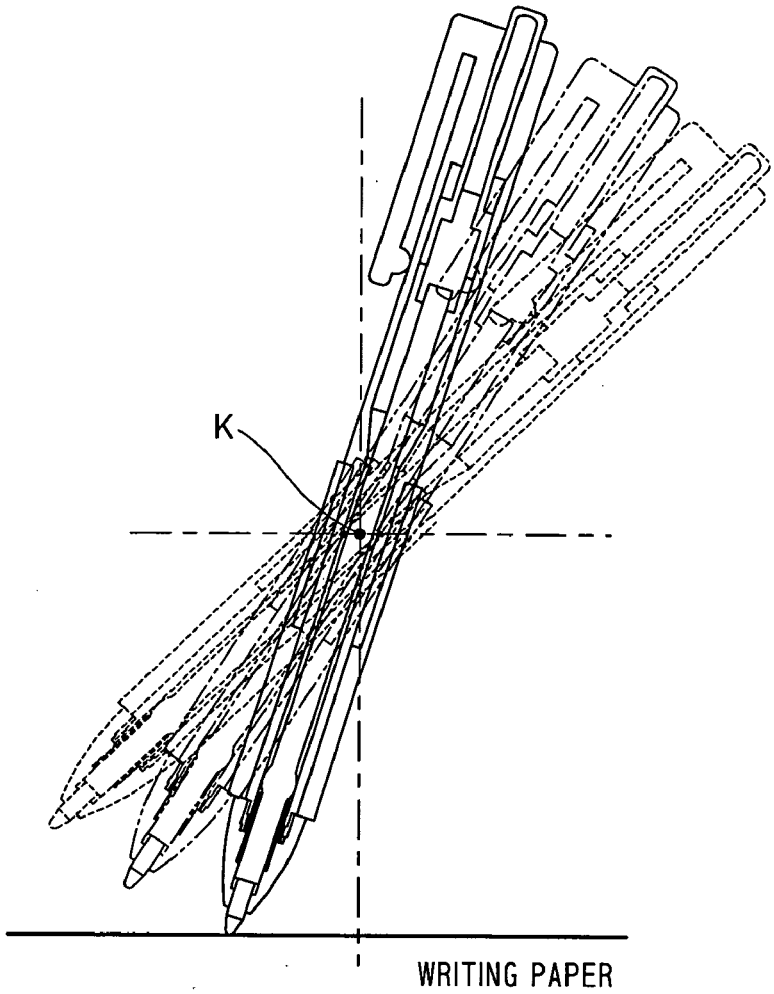
FIG. 3 is a view of assistance in explaining the minute, reciprocating, turning motions of a writing implement.

Referring to FIG. 3, the writing implement makes minute, reciprocating, turning motions to move its writing point up and down when the writing point is shifted from the end of the last stroke of one letter to a position to start writing the next letter. It is generally known that the writing implement turns for this turning motion about an axis K of turning passing through a position substantially corresponding to the middle of the writing implement. The writing implement in the first embodiment is built such that its center of gravity is at a position between the position at 20 mm from the writing point and the position corresponding to the middle of the overall length of the writing implement, preferably, at a position between the middle of a part between the position at 20 mm from the writing point and the position corresponding to the middle of the overall length thereof, and the middle of the overall length thereof. Since the center of gravity is not far apart from the position approximately corresponding to the middle of the writing implement and the axis K is near the center of gravity, the rotational inertia of the writing implement in use is small. Consequently, the writing implement can be smoothly operated in minute, reciprocating, turning motions for satisfactory writing operation.

Figure 4:
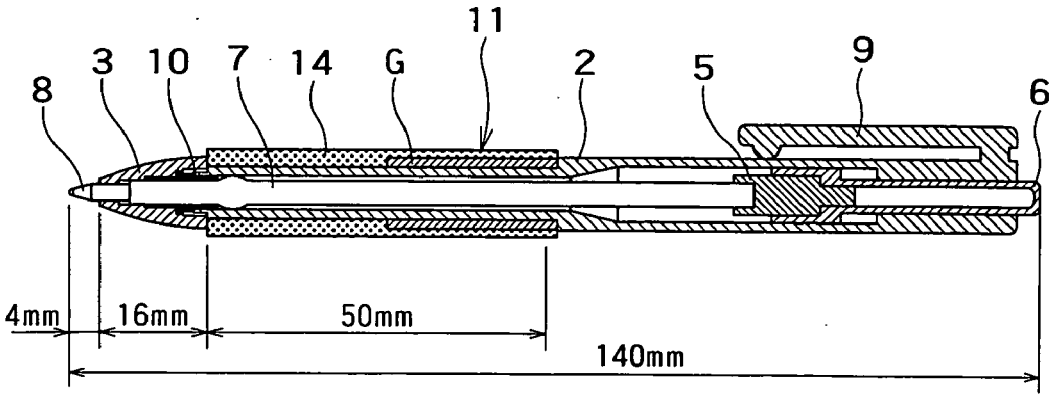
FIG. 4 is a longitudinal sectional view of a writing implement in a second embodiment according to the present invention.

A writing implement 11 in a second embodiment according to the present invention shown in FIG. 4 is a push-button ballpoint pen of a construction similar to that of the writing implement in the first embodiment, except that the writing implement 11 has a barrel 2 having a gripping part provided with a grip member 14 and a weight adjusting part G. The weight adjusting part G is put on a part of the barrel 2 between a position at 20 mm from the writing point and a position corresponding to the middle of the overall length of the writing implement 11. The total weight of the writing implement 11 is 20.8 gf. The weight adjusting part G is formed of brass having a high specific gravity of about 8.3 gf/cm$^3$ and has a weight of 8.4 gf. The weight adjusting part G is the heaviest among the component members of the writing implement 11. The weight adjusting part G has a cylindrical shape and is covered with and concealed by the grip member 14. The writing implement 11 is 140 mm in overall length and has its center of gravity at a position at 64.3 mm from its writing point and a rotational inertia I of about 12,000 gf·mm$^2$ about an axis passing through the center of gravity perpendicularly to the axis thereof.

The weight adjusting part G dominates the weight of the writing implement 11. The weight adjusting part G is effective in localizing most of the weight of the writing implement 11 in a part of the writing implement 11 between the position at 20 mm from the writing point and the position at the middle of the overall length of the writing implement 11, preferably, in a part between the middle of a part between the position at 20 mm from the writing point and the position corresponding to the middle of the overall length thereof, and the middle of the overall length thereof. The weight adjusting part G may be placed inside the barrel 2 and may be any suitable shape other than the cylindrical shape, provided that the weight adjusting part G is placed in a part of the writing implement 11 between the position at 20 mm from the writing point and the position at the middle of the overall length of the writing implement 11. The writing implement 11 provided with the weight adjusting part G has a desired weight, has a small rotational inertia and can be smoothly handled in minute, reciprocating, turning motions for a satisfactory writing operation.

Figure 5:
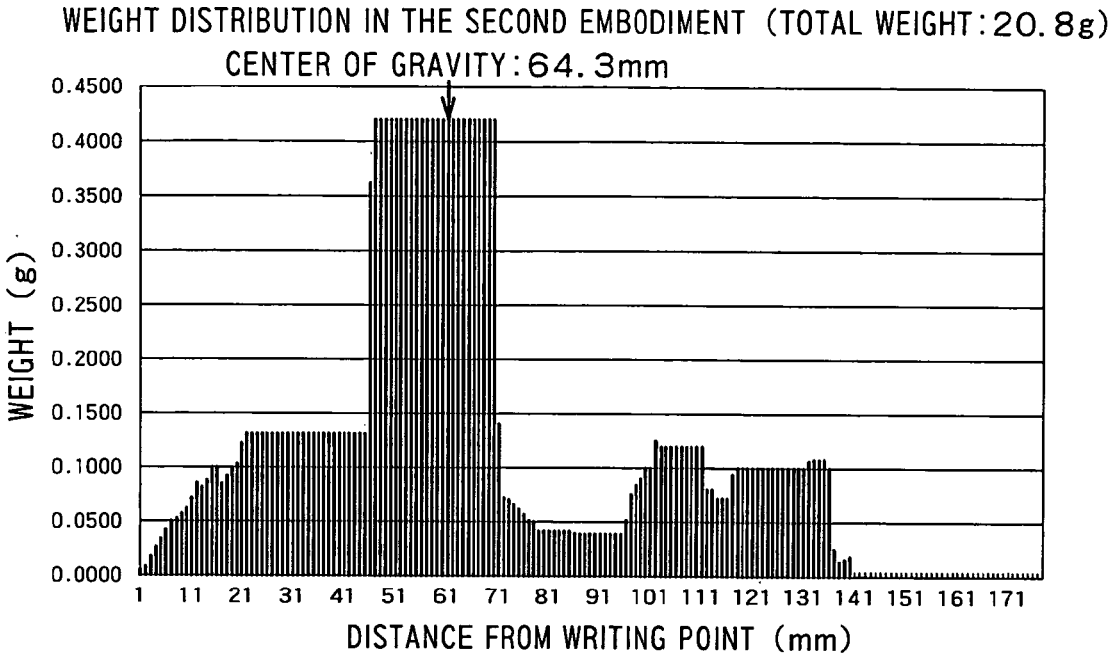
FIG. 5 is a diagram showing weight distribution in the writing implement shown in FIG. 3.

The weight of the writing implement 11 is distributed in a weight distribution curve shown in FIG. 5. The metallic weight adjusting part G is disposed such that the weight of a part between a position at 20 mm from the writing point and a position corresponding to the middle of the overall length of the writing implement 11, i.e., a position at 70 mm from the writing point, is not less than 50% of the total weight of the writing implement 11. More concretely, the weight of the part between the position at 20 mm from the writing point and the position corresponding to the middle of the overall length of the writing implement 11, i.e., the position at 70 mm from the writing point, is 13.9 gf, which is about 67% of the total weight of the writing implement 11.

Figure 6:
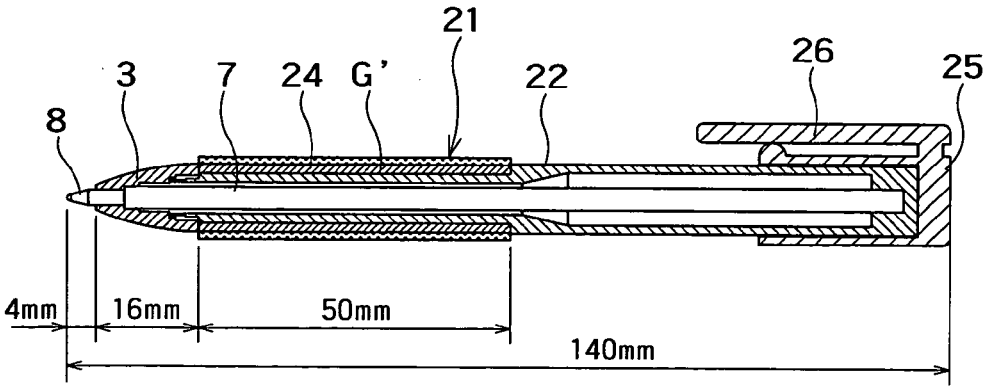
FIG. 6 is a longitudinal sectional view of a writing implement in a third embodiment according to the present invention.
Figure 7:
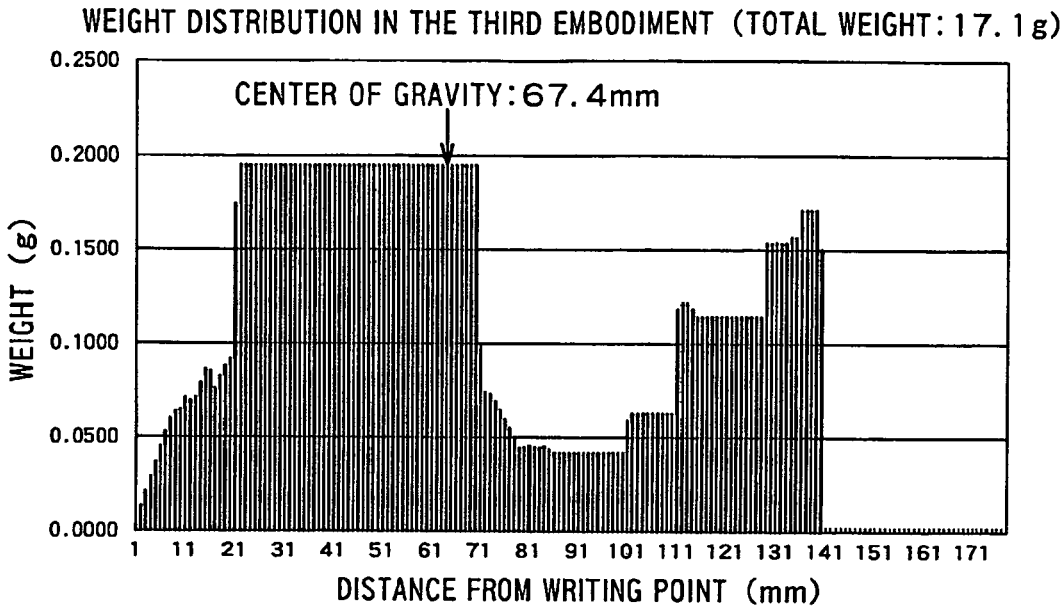
FIG. 7 is a diagram showing weight distribution in the writing implement shown in FIG. 6.

A writing implement 21 in a third embodiment according to the present invention shown in FIG. 6 is a capped ballpoint pen. The writing implement 21 has a barrel 22 having a gripping part, a grip member 24 put on the gripping part of the barrel 22, a weight adjusting part G' put on the gripping part of the barrel 22 to localize most of the weight of the writing implement 21 in a part between a position at 20 mm from a writing point and a position corresponding to the middle of the overall length of the writing implement 21, and a cap 25 integrally provided with a clip 26 and put on a back part of the barrel 2. The weight adjusting part G' is formed of aluminum of about 2.7 gf/cm$^3$ in specific gravity. The cap 25 is formed of a polypropylene resin. The writing implement 21 is 17.1 gf in total weight and 140 mm in overall length. The writing implement 21 has its center of gravity at a position at 67.4 mm from the writing point and a rotational inertia I of about 26,000 gf·mm$^2$ about an axis passing through the center of gravity perpendicularly to the axis of the writing implement 21.

The weight of the writing implement 21 is distributed in a weight distribution curve shown in FIG. 6. The weight of a part between a position at 20 mm from the writing point and a position corresponding to the middle of the overall length of the writing implement 21, i.e., a position at 70 mm from the writing point, is 9.8 gf, which is about 58% of the total weight of the writing implement 21.

Figure 8:
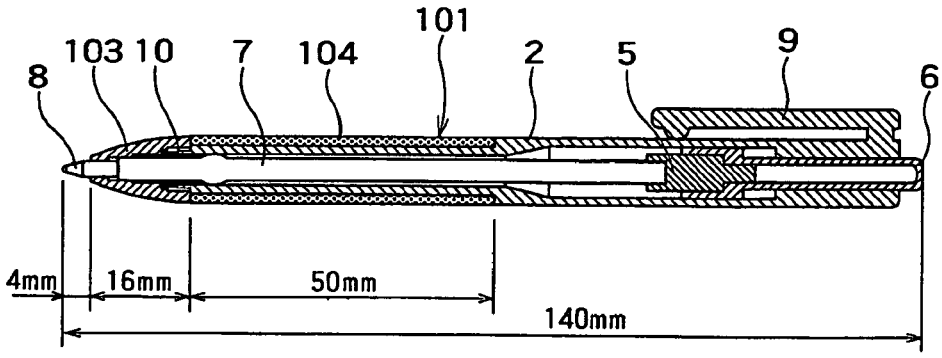
FIG. 8 (PRIOR ART)
FIG. 8 is a longitudinal sectional view of a conventional push-button writing implement.
Figure 9:
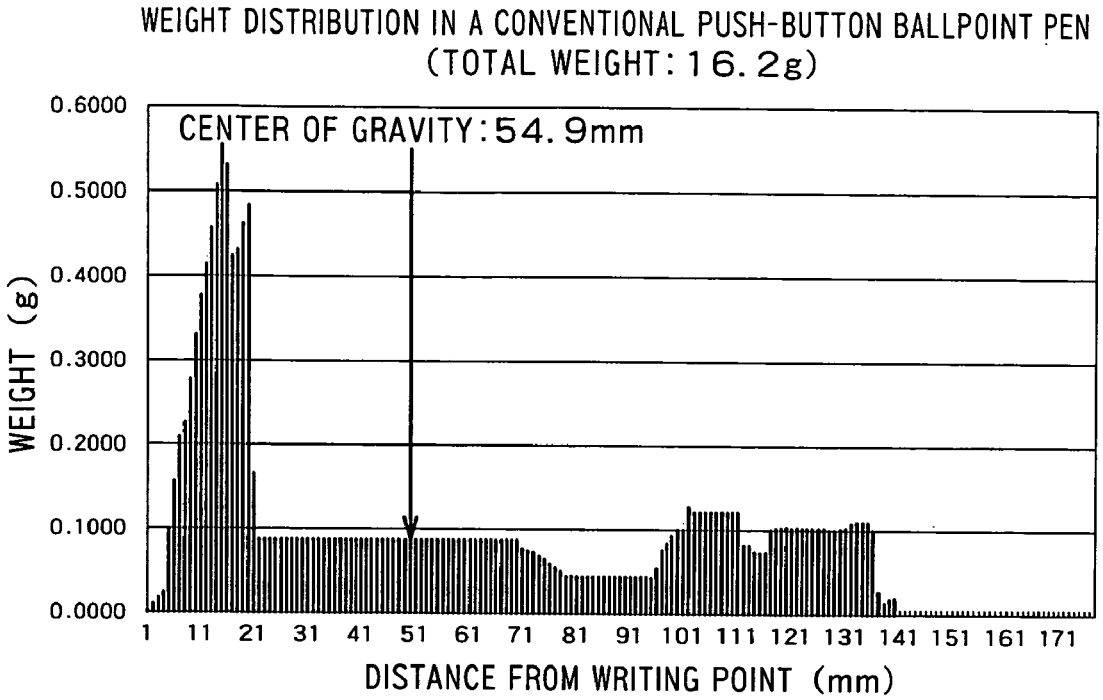
FIG. 9 is a diagram showing weight distribution in the push-button writing implement shown in FIG. 8.

FIG. 8 shows a conventional push-button ballpoint pen (writing implement) 101 similar in construction to the writing implements in the first and the second embodiment. The push-button ballpoint pen 101 has a barrel cap 103 formed of brass, a barrel 2 not provided with any weight adjusting member, and an elastic tube 104 formed of a silicone rubber in a small thickness and put on the barrel 2. The weight of the push-button ballpoint pen 101 is distributed in a weight distribution curve shown in FIG. 9. The push-button ballpoint pen 101 has its center of gravity at a position at 54.9 mm from the writing point, and the weight of a part between a position at 20 mm from the writing point and a position corresponding to the middle of the overall length thereof, i.e., a position at 70 mm from the writing point, is about 31% of the total weight of the push-button ballpoint pen 101, i.e., a weight not greater than 50% of the total weight of the push-button ballpoint pen 101.

More concretely, the push-button ballpoint pen 101 is 16.2 gf in total weight and 140 mm in overall length and has its center of gravity at a position at 54.9 mm from the writing point and a rotational inertia I of about 30,000 gf·mm$^2$ about an axis passing through the center of gravity perpendicularly to the axis of the push-button ballpoint pen 101. The weight of the part of the push-button ballpoint pen 101 between the position at 20 mm from the writing point and the position corresponding to the middle of the overall length of the push-button ballpoint pen 101, i.e., the position at 70 mm from the writing point, is 5.0 gf, which is about 31% of the total weight of the push-button ballpoint pen 101.

Figure 10:
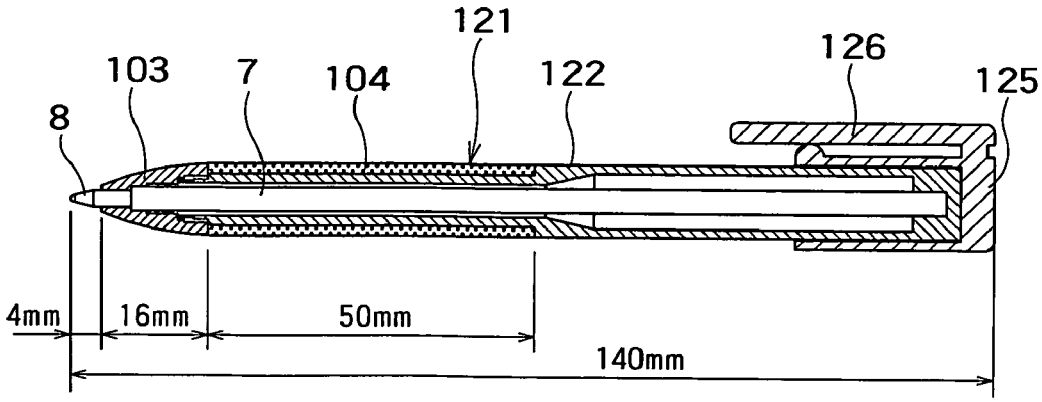
FIG. 10 a longitudinal sectional view of a conventional capped writing implement.
Figure 11:
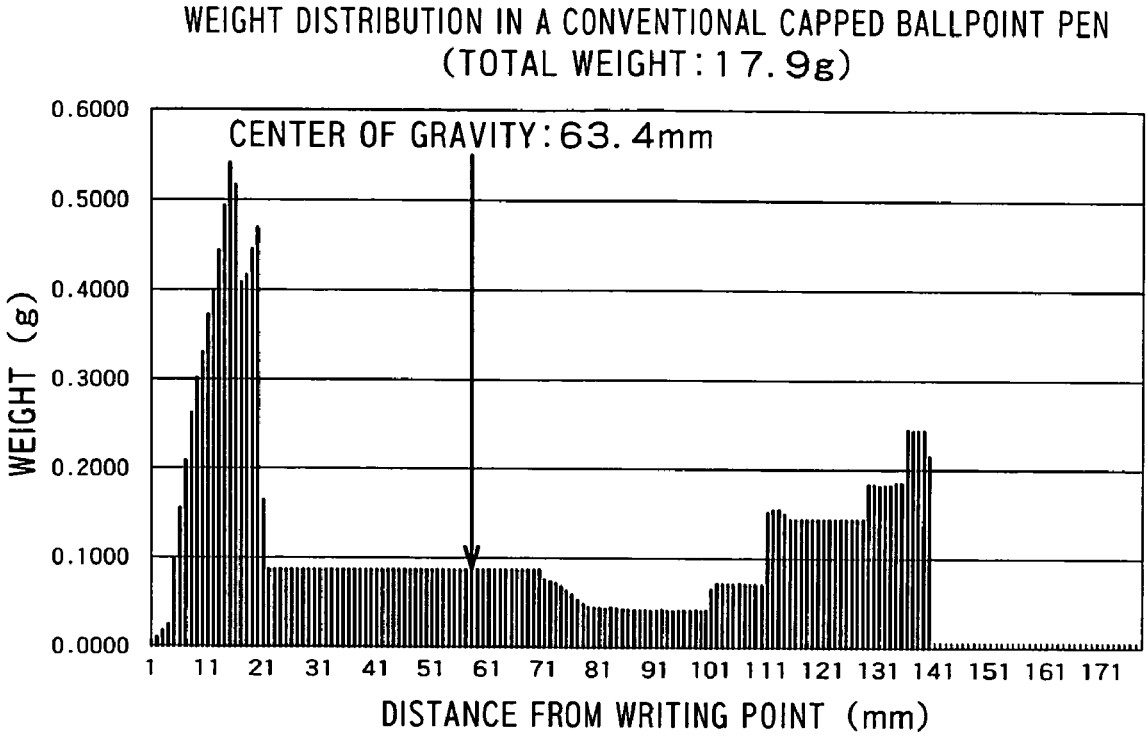
FIG. 11 is a diagram showing weight distribution in the capped writing implement shown in FIG. 10.

FIG. 10 shows a conventional capped ballpoint pen (writing implement) 121. The capped ballpoint pen 121 has a barrel cap 103 formed of brass similar to that of the writing implement in the third embodiment and a cap 125 of a PC resin integrally provided with a clip 126, and does not have any member corresponding to the weight adjusting part. The weight of the capped ballpoint pen 121 is distributed in a weight distribution curve shown in FIG. 11. The weight of a part between a position at 20 mm from the writing point and a position corresponding to the middle of the overall length of the capped ballpoint pen 121, i.e., a position at 70 mm from the writing point, 5.0 gf, which is about 28% of the total weight of the capped ballpoint pen 121, i.e., a weight not greater than 50% of the total weight of the capped ballpoint pen 121.

More concretely, the capped ballpoint pen 121 is 17.9 gf in total weight and 140 mm in overall length and has its center of gravity at a position at 63.4 mm from the writing point and a rotational inertia I of about 41,000 gf·mm$^2$ about an axis passing through the center of gravity perpendicularly to the axis of the push-button ballpoint pen 121. The weight of the part of the capped ballpoint pen 121 between the position at 20 mm from the writing point and the position corresponding to the middle of the overall length of the capped ballpoint pen 121, i.e., the position at 70 mm from the writing point, is 5.0 gf, which is about 38% of the total weight of the capped ballpoint pen 121.

The writing implements in the first and the second embodiment were tested for balance and stability during writing operations in comparison with the conventional push-button writing implement, and the writing implement in the third embodiment was tested for balance and stability during writing operations in comparison with the conventional capped writing implement. The balance and stability of the test writing implements during writing operations were evaluated by one hundred testers (seventy male testers and thirty female testers) of ages between the tens and the fifties. The test writing implements of the present invention superior in balance and stability to the conventional writing implements were marked with a double circle, the test writing implements of the present invention equal in balance and stability to the conventional writing implements were marked with a circle, and the test writing implement of the present invention not superior in balance and stability to the conventional writing elements were marked with a cross. The writing implements marked with a double circle, those marked with a circle and those marked with a cross were about 60%, about 30% and about 10%, respectively, of the test writing implements of the present invention.

In selecting materials for forming the component parts of the conventional writing implement, importance is attached to hardness and strength or matters dominating appearance, such as transparency. Although the position of the center of gravity of the conventional writing implement is specified in designing the conventional writing implement, no attention is paid to weight distribution in the conventional writing implement and, particularly, the weight of a part of the writing implement between a position at 20 mm from the writing point and a position corresponding to the middle of the overall length of the writing implement is not taken into consideration in designing the conventional writing implement. For example, the elastic member of the conventional writing implement is formed of a silicone rubber having a large specific weight between 1.0 and 1.3 gf/cm$^3$, whereas the barrel cap and/or the back end part is formed of a polycarbonate resin having a large specific weight of 1.2 gf/cm$^3$ or a metal such as copper or iron or the barrel cap and/or a back part is formed of a polypropylene resin having a small specific weight between 0.90 and 0.91 gf/cm$^3$, whereas the elastic member is formed of a polyolefin elastomer having a small specific weight of 0.88 gf/cm$^3$. Consequently, the part of the writing implement between the position at 20 mm from the writing point and the position corresponding to the middle of the overall length of the writing implement cannot be formed in a weight not smaller than 50% of the total weight of the writing implement.

Figure 12:
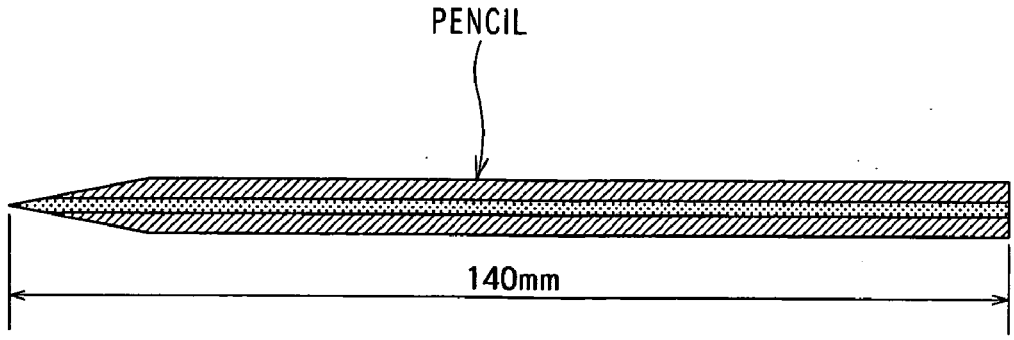
FIG. 12 is a longitudinal sectional view of a pencil.
Figure 13:
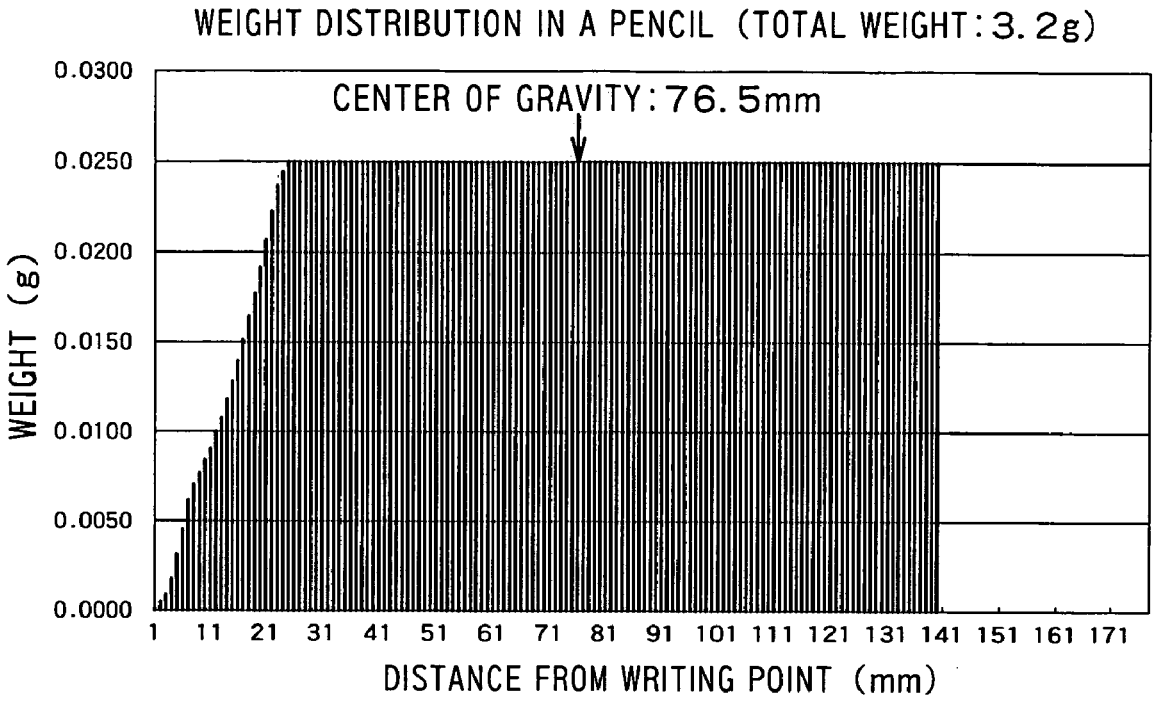
FIG. 13 is a diagram showing weight distribution in the pencil shown in FIG. 12.
Figure 14:
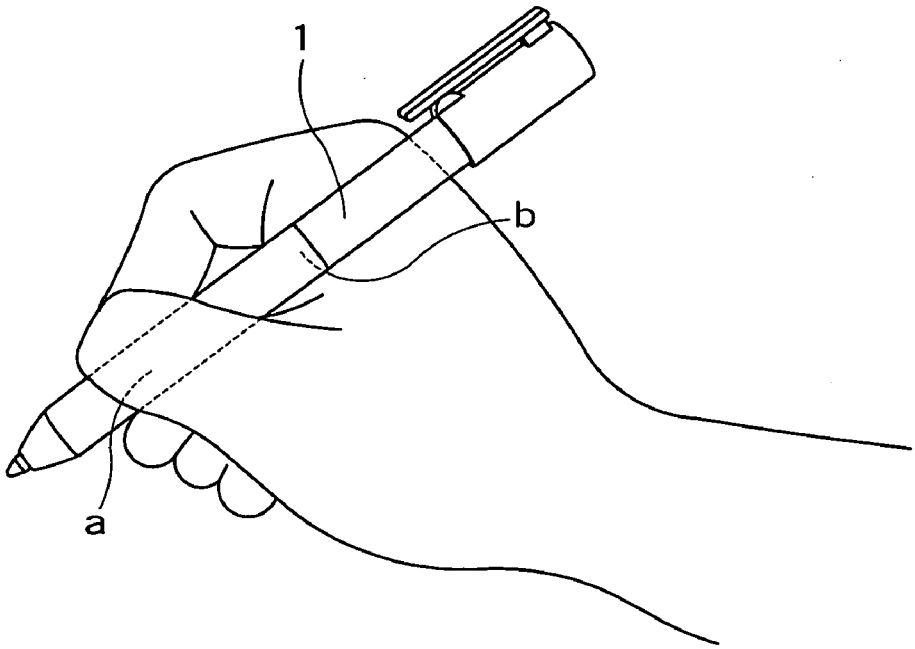
FIG. 14 is a pictorial view of assistance in explaining a mode of gripping a writing implement for writing by placing the tips of the thumb, the first finger and the second finger on a part a and resting a part b at the joint of the thumb and the first finger.

FIG. 12 shows a sharpened pencil ready for writing. The pencil is 3.2 gf in total weight and 140 mm in overall length and has its center of gravity at a position at 76.5 mm from its tip and a rotational inertia I of about 4,300 gf·mm$^2$ about an axis passing through the center of gravity perpendicularly to the axis thereof. The weight of the pencil is distributed in a weight distribution curve shown in FIG. 13. The weight of the pencil excluding the sharpened front part is distributed uniformly. The weight of a part between a position at 20 mm from the tip and a position corresponding to the middle of the overall length of the writing implement 21, i.e., a position at 70 mm from the tip, is 1.3 gf, which is about 40% of the total weight of the pencil.

A writing implement having uniformly distributed weight represented by a pencil is light and hence has a small rotational inertia. However, the weight of a part of the writing implement between a part on which the tips of the thumb, the first finger and the second finger are placed and a part resting on a part at the joint of the thumb and the first finger, i.e., a part between a position at 20 mm from the tip and a position corresponding to the middle of the overall length of the writing implement, is not equal to or greater than 50% of the total weight of the writing implement and hence the writing implement is unsatisfactory in balance and stability during writing operations.

It is essential to the present invention that the weight of a part of a writing implement between a position at 20 mm from the writing point and a position corresponding to the middle of the overall length of the writing implement is not smaller than 50% of the total weight of the writing implement. Therefore, it is desirable that the writing implement of the present invention has a gripping part provided with an elastic member and a weight adjusting member and includes other component parts formed of resins each having a low specific gravity to adjust the wall thickness of the component parts and to take into consideration the distribution of the respective weights of the other component parts.

When the weight of a part of a writing implement between a position at 20 mm from the writing point and a position corresponding to the middle of the overall length of the writing implement is not smaller than 50% of the total weight of the writing implement, the writing implement gives a hand gripping the writing implement a satisfactory sensation of balance and stability, the rotational inertia of the writing implement is small and the writing implement can be smoothly handled for minute, reciprocating, turning motions. If the weight of a part of a writing implement between a position at 20 mm from the writing point and a position corresponding to the middle of the overall length of the writing implement is less than 50% of the total weight of the writing implement, it is possible that a front part other than the part between the position at 20 mm from the writing point and the position corresponding to the middle of the overall length of the writing implement or a rear part is heavy and it is possible that the writing implement is ill-balanced during writing operations.

As mentioned above, there is not any particular restrictions on the construction of the writing implement of the present invention, provided that the weight of a part of the writing implement between a position at 20 mm from the writing point and a position corresponding to the middle of the overall length of the writing implement is not smaller than 50% of the total weight of the writing implement. The center of gravity of the writing implement can be easily set at a position in and a weight not less than 50% of the total weight of the writing implement can be easily distributed in the part of the writing implement between a position at 20 mm from the writing point and a position corresponding to the middle of the overall length of the writing implement by weighting the part of the writing implement between a position at 20 mm from the writing point and a position corresponding to the middle of the overall length of the writing implement.

A comparatively heavy writing implement of 15 gf or above in total weight can give a pleasant weighty sensation as compared with a comparatively light writing implement of a weight on the order of 10 gf including most of the component parts formed of resins. Since the front part including the barrel cap and a knob and/or a back part of the conventional writing implement is formed of a metal having a high specific gravity, such as brass or iron, to form the writing implement in a comparatively large weight, it is difficult to set the center of gravity of the writing implement at a position in and to distribute a weight not less than 50% of the total weight of the writing implement in the part of the writing implement between a position at 20 mm from the writing point and a position corresponding to the middle of the overall length of the writing implement. Thus, the constitution and effect of the present invention are worth appreciation.

If a component member distant from the axis of turning of the conventional writing implement which is not satisfactory in balance and stability during writing operations and which is incapable of smoothly achieving minute, reciprocating, turning motions passes through the center of gravity and is formed of a metal having a large specific weight, such as brass or iron, the writing implement has a large rotational inertia. For example, a heavy conventional writing implement of 15 gf or above in total weight has a rotational inertia not smaller than 20,000 gf·mm$^2$. The rotational inertia of a writing implement satisfactory in balance and stability during writing operations and capable of smoothly achieving minute, reciprocating, turning motions must be less than 30,000 gf·mm$^2$. A writing implement having a rotational inertia not greater than 25,000 gf·mm$^2$ is able to exhibit the effect of the present invention. Preferably, a writing implement according to the present invention has a rotational inertia not greater than 20,000 gf·mm$^2$. Such a writing implement is able to exhibit the effect of the present invention more effectively.

The smaller the rotational inertia of the writing implement, the better is the turning performance of the writing implement in minute, reciprocating, turning motions and the easier it is to stop the writing implement. The rotational inertia of a pencil is as small as about 4,300 gf·mm$^2$. If a writing implement has a rotational inertia less than 4,300 gf·mm$^2$, the writing implement looks cheap and lightweight even if the writing implement is formed in a large weight of 15 gf or above greater than those of cheap writing implements. Therefore, it is desirable to form a writing implement so that 4,300 gf·mm$^2 \leqq I \leqq 25{,}000$ gf·mm$^2$, preferably 4,300 gf·mm$^2 \leqq I \leqq 20{,}000$ gf·mm$^2$, where I is the rotational inertia of the writing implement.

A part of a writing implement between a position at 20 mm from the writing point of the writing implement and a position corresponding to the middle of the overall length of the writing implement can be easily formed in a weight not less than 50% of the total weight of the writing implement and the weight of the writing implement can be easily distributed such that most part of the weight is distributed around the center of gravity of the writing implement by forming a component part in a front part of the writing implement and/or a component part in a back part of the writing implement of a metal having a low specific gravity or a resin having a low specific gravity. Since the component part formed of a metal having a low specific gravity or a resin having a low specific gravity is in the front part and/or the back part of the writing implement and is distant from the center of gravity, the effect of the component part on increasing the rotational inertia of the writing implement is insignificant and hence the rotational inertia of the writing implement is small.

Although the push-button ballpoint pen provided with the rotary cam and the capped ball-point pen have been described by way of example, the construction of the writing tip and the ink are not limited to those specifically described herein. The present invention is applicable also to push-button writing implements and capped writing implements of construction other than that specifically described herein. The capped writing implement is expected to be used for writing with its cap put on its back part. The position of the center of gravity and the total weight of the capped writing implement is determined in a state where the cap is put on the back part of the capped writing implement. The present invention can be particularly effectively applied to the push-button writing implement with the rotary cam as mentioned above because many component parts including the rotary cam and the push button are arranged in a back part of the barrel.

The writing implement according to the present invention is satisfactory in balance and stability during writing operations and is capable of being smoothly handled for minute, reciprocating, turning motions during writing motions.

The invention claimed is:

1. A writing implement having a center of gravity at a position between a position 20 mm from a writing tip and a position corresponding to a middle of an overall length of the writing implement, wherein a weight of a portion of the writing implement between the position 20 mm from the writing tip and the position corresponding to the middle of the overall length of the writing implement is not less than 50% of a total weight of the writing implement, and wherein a rotational inertia of the writing implement is between 4,300 and 25,000 gf·mm$^2$ about an axis passing through the center of gravity.

2. The writing implement according to claim 1, wherein the center of gravity is located at a position between (1) a middle of a length of a portion of the writing implement extending from the position 20 mm from the writing tip to the position corresponding, to the middle of the overall length of the writing implement, and (2) the middle of the overall length of the writing implement.

3. The writing implement according to claim 2, wherein the writing implement includes a weight adjusting member arranged between the position 20 mm from the writing tip and the position corresponding to the middle of the overall length of the writing implement.

4. The writing implement according to claim 3, wherein at least one of a tip part and a back part of the writing implement is formed of a metal having a low specific gravity or a resin having a low specific gravity.

5. The writing implement according to claim 4, wherein the at least one of the tip part and the back part of the writing implement is formed of a metal or a resin having a specific gravity lower than a specific gravity of a portion of the writing implement arranged between the position 20 mm from the writing tip and the position corresponding to the middle of the overall length of the writing implement.

6. The writing implement according to claim 3, wherein the weight adjusting part is formed of a metal.

7. The writing implement according to claim 6, wherein at least one of a tip part and a back part of the writing implement is formed of a metal having a low specific gravity or a resin having a low specific gravity.

8. The writing implement according to claim 2, wherein at least one of a tip part and a back part of the writing implement is formed of a metal having a low specific gravity or a resin having a low specific gravity.

9. The writing implement according to claim 8, wherein the at least one of the tip part and the back part of the writing implement is formed of a metal or a resin having a specific gravity lower than a specific gravity of a portion of the writing implement arranged between the position 20 mm from the writing tip and the position corresponding to the middle of the overall length of the writing implement.

10. The writing implement according to claim 1, wherein the writing implement includes a weight adjusting member arranged between the position 20 mm from the writing tip and the position corresponding to the middle of the overall length of the writing implement.

11. The writing implement according to claim 10, wherein at least one of a tip part and a back part of the writing implement is formed of a metal having a low specific gravity or a resin having a low specific gravity.

12. The writing implement according to claim 11, wherein the at least one of the tip part and the back part of the writing implement is formed of a metal or a resin having a specific gravity lower than a specific gravity of a portion of the writing implement arranged between the position 20 mm from the writing tip and the position corresponding to the middle of the overall length of the writing implement.

13. The writing implement according to claim 10 wherein the weight adjusting part is formed of a metal.

14. The writing implement according to claim 13, wherein at least one of a tip part and a back part of the writing implement is formed of a metal having a low specific gravity or a resin having a low specific gravity.

15. The writing implement according to claim 14, wherein the at least one of the tip part and the back part of the writing implement is formed of a metal or a resin having a specific gravity lower than a specific gravity of a portion of the writing implement arranged between the position 20 mm from the writing tip and the position corresponding to the middle of the overall length of the writing implement.

16. The writing implement according to claim 1, wherein at least one of a tip part and a back part of the writing implement is formed of a metal having a low specific gravity or a resin having a low specific gravity.

17. The writing implement according to claim 16, wherein the at least one of the tip part and the back part of the writing implement is formed of a metal or a resin having a specific gravity lower than a specific gravity of a portion of the writing implement arranged between the position 20 mm from the writing tip and the position corresponding to the middle of the overall length of the writing implement.

18. The writing implement according to claim 1, wherein the total weight of the writing implement is greater than or equal to 15 gf.

19. The writing implement according to claim 1, wherein the rotational inertia about the axis passing through the center of gravity is less than or equal to 20,000 $gf \cdot mm^2$.

* * * * *